US006321913B1

(12) United States Patent
Rebel et al.

(10) Patent No.: US 6,321,913 B1
(45) Date of Patent: Nov. 27, 2001

(54) SORTING FACILITY FOR FLAT MAIL ITEMS

(75) Inventors: Burghard Rebel, Constance; Bertram Wanner, Meersburg; Karsten Knipper, Mägdebergstrasse; Raymond P. Brady, Pullach, all of (DE); Christoph Maurer, Salzburg (AT); Rudolf Schuster, Kirchheim (DE); Adolf Hoepler, München (DE); Christian Kassel, Riemerling (DE); Matthias Stroessner, Oberhaching (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/646,035

(22) PCT Filed: Mar. 9, 1999

(86) PCT No.: PCT/DE99/00621

§ 371 Date: Sep. 13, 2000

§ 102(e) Date: Sep. 13, 2000

(87) PCT Pub. No.: WO99/47278

PCT Pub. Date: Sep. 23, 1999

(30) Foreign Application Priority Data

Mar. 13, 1998 (DE) ..... 198 11 079

(51) Int. Cl.[7] ..... B07C 5/00

(52) U.S. Cl. ..... 209/509; 209/559; 209/560

(58) Field of Search ..... 209/559, 560; 198/604, 605, 621.1, 690.2, 699

(56) References Cited

U.S. PATENT DOCUMENTS

| | | | | |
|---|---|---|---|---|
| 4,610,359 | | 9/1986 | Müller . | |
| 4,986,423 | | 1/1991 | Takeda . | |
| 5,096,067 | * | 3/1992 | Tutamune et al. | 209/551 |
| 5,390,429 | * | 2/1995 | Long | 34/580 |

FOREIGN PATENT DOCUMENTS

| | | |
|---|---|---|
| 30 15 829 | 11/1980 | (DE) . |
| 3015829 C2 | 11/1980 | (DE) . |
| 43 00 758 A 1 | 7/1994 | (DE) . |
| 44 37 114 | 12/1995 | (DE) . |
| 44 37 114 C 1 | 12/1995 | (DE) . |
| WO 95/02468 | 1/1995 | (WO) . |

* cited by examiner

*Primary Examiner*—Donald P. Walsh
*Assistant Examiner*—Mark J Beauchaine
(74) *Attorney, Agent, or Firm*—Venable; George H. Spencer; Robert Kinberg

(57) ABSTRACT

A conveyor belt (1) leading to a sorting device (2) comprises two superimposed functional sections (3, 12), which are connected to each other via deflected intermediate sections. As a result, the structural length of the conveyor belt (1) is reduced.

5 Claims, 1 Drawing Sheet

SORTING FACILITY FOR FLAT MAIL ITEMS

Figure 1:
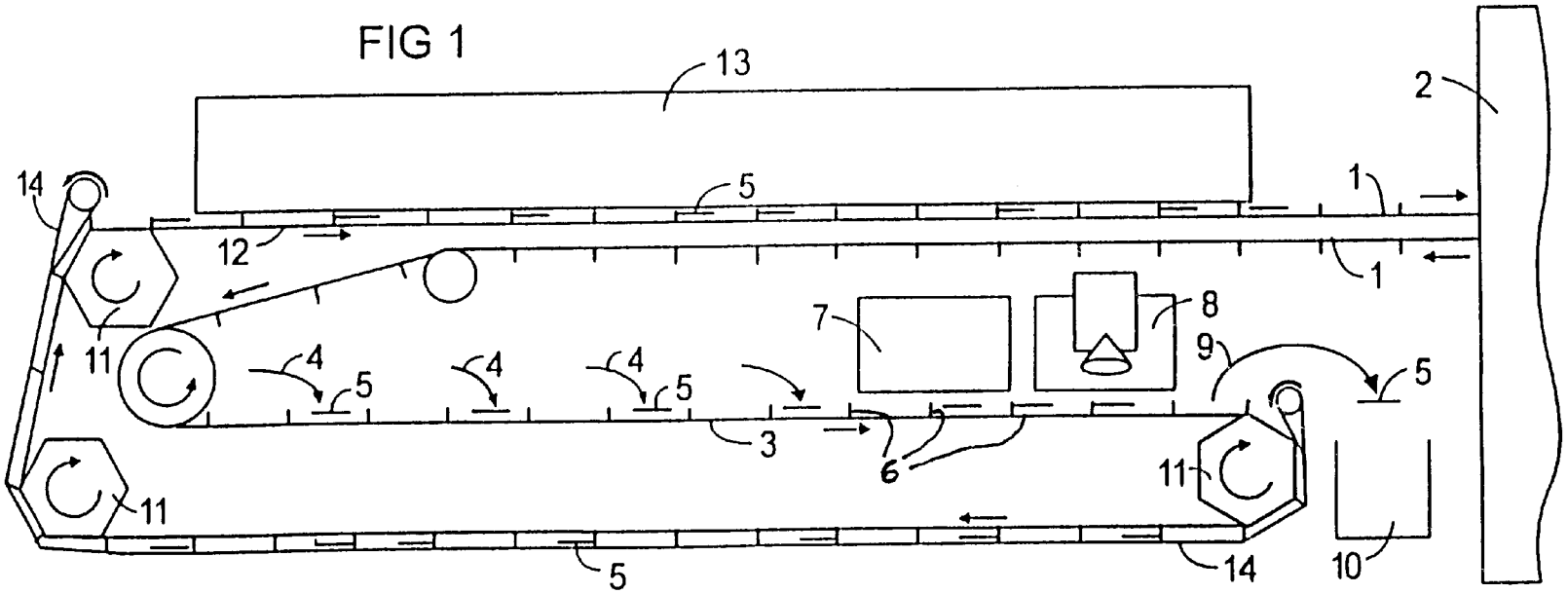

The invention relates to a sorting facility for flat mail items, comprising a rotating conveyor belt leading to a sorting device.

BACKGROUND OF THE INVENTION

A sorting device for flat mail items is known, for example from the WO 95/02468. It is standard practice to feed the mail items to the sorting device by means of a conveyor belt, which comprises several successive processing stations along a horizontal, straight transporting section. Processing stations of this type are input stations, for example, in which the mail items are supplied by side belts to the conveyor belt. Other stations, for example, are an alignment station, a viewing station, an ejection station and subsequently installed printing stations for imprinting the mail items with signatures corresponding to the delivery addresses.

In the viewing station, the position of the mail items is checked and the delivery address read in. The subsequently installed ejector device then removes incorrectly positioned mail items from the belt toward the side. Addresses with unclear printing are transmitted to a workstation where they are corrected. Owing to the fact that this process requires a longer period of time, the section between the viewing station and the final processing must be correspondingly long.

An intermediate storage area is described in the U.S. Pat. No. 4,986,423, in which letter shipments are transported at different levels while clamped between a system of cover belts with relatively small deflection radii.

SUMMARY OF THE INVENTION

However, these mail items concern relatively thin, flexible letters that allow such small bending radii. As a result of being clamped in completely during the transport, a spatial orientation during the transport is not necessary. If relatively rigid large envelopes, magazines and the like, meaning items with strongly differing thickness, are to be processed, they cannot be transported securely and without being displaced while clamped inside a cover belt system.

DESCRIPTION OF THE PREFERRED EMBODIMENTS

In accordance with this and other objects of the invention, a sorting facility for flat mail items is provided. The sorting facility according to the invention leads to a sorting device. The facility comprises a conveyor belt constructed and arranged to follow a serpentine path whereby respective sections of the belt are disposed above one another. The conveyor belt is separated into equal sections by means of end stops that can rotate to be disposed closer to their respective belt sections. Successive processing stations for receiving flat positioned mail items are disposed along horizontally oriented sections of the belt. In one aspect of a sorting facility according to the invention, as a particular first horizontally oriented section of the conveyor is in proximity to initial processing stations along the belt pathway, the first section is positioned below a second horizontally oriented section of the conveyor belt when the second horizontally oriented section is in proximity with upper subsequent processing stations.

In accordance with another aspect of the invention, the conveyor belt traverses across deflection devices that are constructed and arranged such that they determine changes of direction of the conveyor belt along its path. The belt exits from the sorting device, is directed over rollers to reverse direction to a first horizontally oriented section, around a first deflection device to reverse direction and be disposed below the first horizontal section. The conveyor belt then traverses a second deflection device to turn upwardly, and then traverses a third deflection device to turn back toward the sorting device such that the belt is disposed along the second horizontally oriented section. A cover belt is constructed and arranged over portions of the conveyor belt and over the three deflection devices in the deflection region such that it makes contact with the end stops.

In accordance with further objects of the invention, a sorting facility according to the invention is further provided with an ejection station along the first horizontally oriented section and near the first deflector for ejecting incorrectly positioned mail items in the transporting direction from the belt and into a reservoir. The sorting facility of the invention can be further provided with a viewing station for address recognition of mail items wherein the viewing station is arranged before the ejection station with respect to the direction of movement of the belt, and can be further provided with a processing station adaptable as a printing station and which is located in the second horizontally disposed section.

In accordance with other aspects of the invention, the conveyor belt is deflected around the first deflection device to reverse direction preferably by approximately 180 degrees, and is deflected upwardly by the second deflection device preferably by approximately 90 degrees, and then is deflected horizontally by the third deflection device approximately 90 degrees to turn back toward the sorting device such that the belt is disposed along the second horizontally oriented section. Preferably, the deflection devices are designed as circular, equal-sided polygons, the side length of which corresponds to the separation distance between the mail items and the transporting position of the mail items is adjusted to the angle position of the deflection devices (11), such that the preferably rounded corner regions of the deflection devices are positioned between successive mail items such that the end stops are guided over the corner regions of the deflection devices.

It is the object of the invention to reduce the structural length of the conveyor belt with processing stations. This object is solved with the invention according to claim 1.

The deflection of the conveyor belt allows distributing the processing stations to superimposed sections of the conveyor belt, so that the total length is reduced. With these steps, the arrangement of the conveyor belt is adapted to the multi-level structural design of the sorting device, which is possible without problems given the room height that is available. The covering device prevents mail items from falling down, for example in sections where the conveyor belt is in the reversed transporting position.

Advantageous modifications are characterized in claims 2 to 5:

The modification according to claim 2 makes it possible to arrange a collection container for the ejected mail items in the conveyor belt extension, such that the mail items can be ejected in transporting direction. As a result, the structural width of the ejection station is reduced. For the ejection itself, the movement component of the conveyor belt is used, so that this operation can be realized with simpler mechanical means. The ejection curve avoids a lateral movement and follows a simple trajectory parabola with correspondingly improved target accuracy.

As a result of the modification according to claim 3, an empty section is inserted between the viewing station and the printing station, which is long enough so that the time interval necessary for correcting the address can be maintained without requiring additional area.

Owing to the deflection devices according to claim 4, a vertical section is formed, which permits the required height difference.

The sorting facility according to claim 5 makes it possible to guide the mail items without bending over the roller-type deflection devices. As a result of the rounding of the polygon edges, it is possible to reduce the number of its sides, such that the smallest possible envelope diameter is achieved without an impermissible bending of the conveyor belt. In the process, a defined position of the mail items is achieved on the conveyor belt, so that a bending can be securely avoided.

In the following, the invention is explained in further detail with the aid of a drawing showing an exemplary embodiment.

FIG. 1 schematically shows the course of a rotating conveyor belt 1, which meanders according to the straight arrows, toward a sorting device 2. The conveyor belt 1, which is horizontally oriented in lateral direction, comprises a first section 3 that extends in horizontal direction and contains several successively arranged input stations 4 for flat mail items 5. Evenly spaced projecting end stops 6 are provided on the top of the conveyor belt 1, thus forming holding compartments for the mail items 5.

Following the input stations 4, the mail items 5 are aligned in an alignment station 7 at the end stops 6. A subsequently installed viewing station 8 detects the delivery addresses affixed to the mail items 5 and checks the position of mail items 5 on the conveyor belt. An adjoining ejection station 9 removes, for example, wrongly positioned mail items 5 or items that are too large from the conveyor belt 1 to a collection container 10. The conveyor belt 1 is deflected by 180° in an immediately following, roller-type deflection device 11 and is returned to its start below the first section 3. The collection container 10 is located in the extension of the first section 3, so that the transported items 5 to be ejected from the extended transporting direction can be sorted out in a simple trajectory parabola and without lateral movement into the collection container 10.

The conveyor belt 1 is deflected via two additional deflection devices 11 by respectively approximately 90° to a second functional section 12, which extends above the first section 3 and parallel to it. Above this functional section 12 is at least one further processing station in the form of a printing station 13, in which the mail items 5 can be provided with a characterizing signature. The viewing station 8 and the printing station 13 are connected via non-depicted data lines to a monitor work station that is not shown here, on which inaccurately read addresses can be corrected manually. With the present invention, the conveyor belt 1 between the viewing station 8 and the printing station 13 can be kept just long enough so that given the small area, sufficient time is provided for correcting the addresses.

In order to secure the transported items on the conveyor belt 1, between the first section 3 and the functional section 12, this intermediate section is provided with a cover belt 14 that also circulates along and fits tightly against the conveyor belt 1.

As shown with the round arrows, the deflection devices 11 that rotate along with the conveyor belt 1 are designed as roller-type, equal-sided polygons, having a side length that corresponds to the distance between two successive end stops 6. The conveyor belt 1 is adjusted relative to the deflection devices 11, such that the end stops 6 are respectively located in the corner region of the deflection devices 1. The section of conveyor belt 1, on which the mail items 5 rest, fits in a straight line against the flat sides of the deflection device. As a result, the mail items 5 are respectively arranged above the straight-line sides of the polygons and thus cannot be bent during the deflection.

What is claimed is:

1. A sorting facility for flat mail items (5) leading to a sorting device (2), said facility comprising a rotating conveyor belt (1) that is separated into equal sections by means of end stops (6), wherein the conveyor belt has assigned to it in horizontally oriented sections (3, 12) several successive processing stations (e.g. 4, 7, 8, 9, 13) for flat positioned mail items (5) characterized in that a first horizontally oriented section (3) with the preceding processing stations (4, 7, 8, 9) is arranged below a second horizontally oriented sections (12) with subsequently installed processing stations (13) and the return of the conveyor belt (1) from the sorting device (2), that following the first horizontally oriented section (3), the conveyor belt (1) is guided around at least two deflection devices (11) around the first section (3) to the second horizontally oriented section (12), wherein a cover belt (14) that rotates along in part is provided in the deflection region, on the side of end stops (6), which makes contact with the end stops and is also guided by the deflections devices (11).

2. A sorting facility according to claim 1, characterized in that the last work station of the first horizontally oriented section (3) is an ejection station (9) for incorrectly positioned mail items (5), for which the ejection direction is in transporting direction of the first section (3).

3. A sorting facility according to claim 1, characterized in that a viewing station (8) for the address recognition is arranged in front of the ejection station (9) and that a further processing station is designed as printing station (13), which is located in the second section (12).

4. A sorting facility according to claim 3, characterized in that the conveyor belt (1) is deflected in a first deflection device (11) by 180° and is deflected in a second and third deflection device (11) each by approximately 90°.

5. A sorting facility according to claim 1, characterized in that the deflection devices (11) are designed as circular, equal-sided polygons, the side length of which corresponds to the separation distance between the mail items (5) and that the transporting position of the mail items (5) is adjusted to the angle position of the deflection devices (11), such that the preferably rounded corner regions of the deflection devices (11) are positioned between successive mail items (5), wherein the end stops (6) are guided over the corner regions of the deflection devices (11).

* * * * *